United States Patent [19]

Vignale

[11] Patent Number: 4,827,849

[45] Date of Patent: May 9, 1989

[54] TOWEL BAR SHELF

[76] Inventor: Grace M. Vignale, 355 Garden St., Deland, Fla. 32720

[21] Appl. No.: 143,359

[22] Filed: Jan. 12, 1988

[51] Int. Cl.[4] ..... A47B 41/04

[52] U.S. Cl. ..... 108/29; 108/42; 248/214; 211/88

[58] Field of Search ..... 108/42, 29, 16, 152, 108/30, 47, 48, 90; 248/214, 235, 316.2, 316.3, 231.3; 211/88, 16, 32, 90

[56] References Cited

U.S. PATENT DOCUMENTS

| | | | |
|---|---|---|---|
| 1,452,144 | 4/1923 | Carlin | 108/29 |
| 1,538,059 | 5/1925 | Robison | 248/214 |
| 2,258,178 | 10/1941 | Haffner | 108/29 |
| 2,612,273 | 9/1952 | Smith | 248/214 X |
| 3,233,744 | 2/1966 | Ripps | 248/214 X |
| 4,126,231 | 11/1978 | Derwent-Wryde | 108/29 X |
| 4,181,382 | 1/1980 | Harvey | 248/214 X |
| 4,191,110 | 3/1980 | Klukos | 211/88 X |
| 4,233,911 | 11/1980 | Vienale | 211/88 X |
| 4,508,301 | 4/1985 | Nicholson et al. | 240/235 X |

FOREIGN PATENT DOCUMENTS

| | | | |
|---|---|---|---|
| 1580482 | 9/1969 | France | 108/42 |

*Primary Examiner*—Kenneth J. Dorner
*Assistant Examiner*—José V. Chen
*Attorney, Agent, or Firm*—Warren L. Franz

[57] ABSTRACT

A shelf assembly has a horizontal toiletry article supporting tray with wedge-shaped brackets formed as depending extensions of the left and right ends of the tray. Vertical rear edges of the brackets abut a wall and angled front edges bear against a conventional towel bar to removably secure the shelf behind the bar and to elevate the tray to permit normal usage of the bar to hang towels. The rear of the tray has an upwardly extending flange which serves as a shelf back abutting the wall. Rods are provided on its left, front and right edges to present a raised lip to keep articles on the shelf. The tray, brackets and flange are preferably formed as an integral, unitary structure of acrylic plastic.

16 Claims, 1 Drawing Sheet

TOWEL BAR SHELF

This invention relates to a removable shelf assembly having an article supporting tray received in elevated position above a towel bar supported at a fixed distance from a vertical wall.

BACKGROUND OF THE INVENTION

This invention is an improvement over the towel rack shelf assembly shown in U.S. Pat. No. 4,233,911 the same inventor which provides a plate or tray that rests directly above and in contact with a towel bar, providing a convenient storage area for bathroom articles, cosmetics and the like.

The shelf assembly of U.S. Pat. No. 4,233,911 horizontal plate or tray from the opposite ends of which depend "S"-shaped brackets that clip behind then descend ahead of the bar, curving down to terminate in forwardly facing hooked ends. The forwardly extending portion at the upper end of each bracket rests directly above the bar, positioning the under surface of the tray either in contact with or just above the bar. The close proximity of the tray to the bar renders the portions of the bar underlying the tray unusable for hanging towels.

While the shelf assembly of U.S. Pat. No. 4,233,911 offers many advantages over prior art shelving units, the same inventor has improved thereon to provide a removable towel bar shelf of simpler, unitary construction having wedge-shaped brackets that fit behind the bar and against the wall to elevate the tray above the bar to permit normal usage of the towel bar as intended, yet provide usable shelf space for storage of toiletries, and the like. In contrast to U.S. Pat. No. 4,233,911 structure, the improvement does not require the use of clips, or the like, to fasten the assembly to the bar.

SUMMARY OF THE INVENTION

The present invention provides a removable towel bar shelf assembly having a horizontal article supporting tray and a pair of wedge-shaped brackets depending from longitudinally spaced positions along said tray. Each bracket has a vertical rear edge that abuts the wall and an angled front edge that bears against the bar. The relative dimensions of the upper and lower sections of the brackets and the angling of their front edges function to hold the brackets in secure position behind the towel bar, and at the same time elevate the tray sufficiently above the bar to permit normal usage of underlying portions of the bar to hang towels.

In a preferred embodiment, described in greater detail below, the shelf assembly is of simple, aesthetically pleasing integral, unitary construction made of a durable transparent or translucent plastic material. An upwardly extending flange is provided in abutment with the wall along the rear of the tray, and a raised rim extends about the periphery of the upper surface of the tray to keep articles thereon.

BRIEF DESCRIPTION OF THE DRAWINGS

An embodiment of the invention has been chosen for purposes of illustration and description, and is shown in the accompanying drawings, wherein.

Throughout the drawings, like elements are referred to by like numerals.

DESCRIPTION OF THE PREFERRED EMBODIMENT

Figure 1:
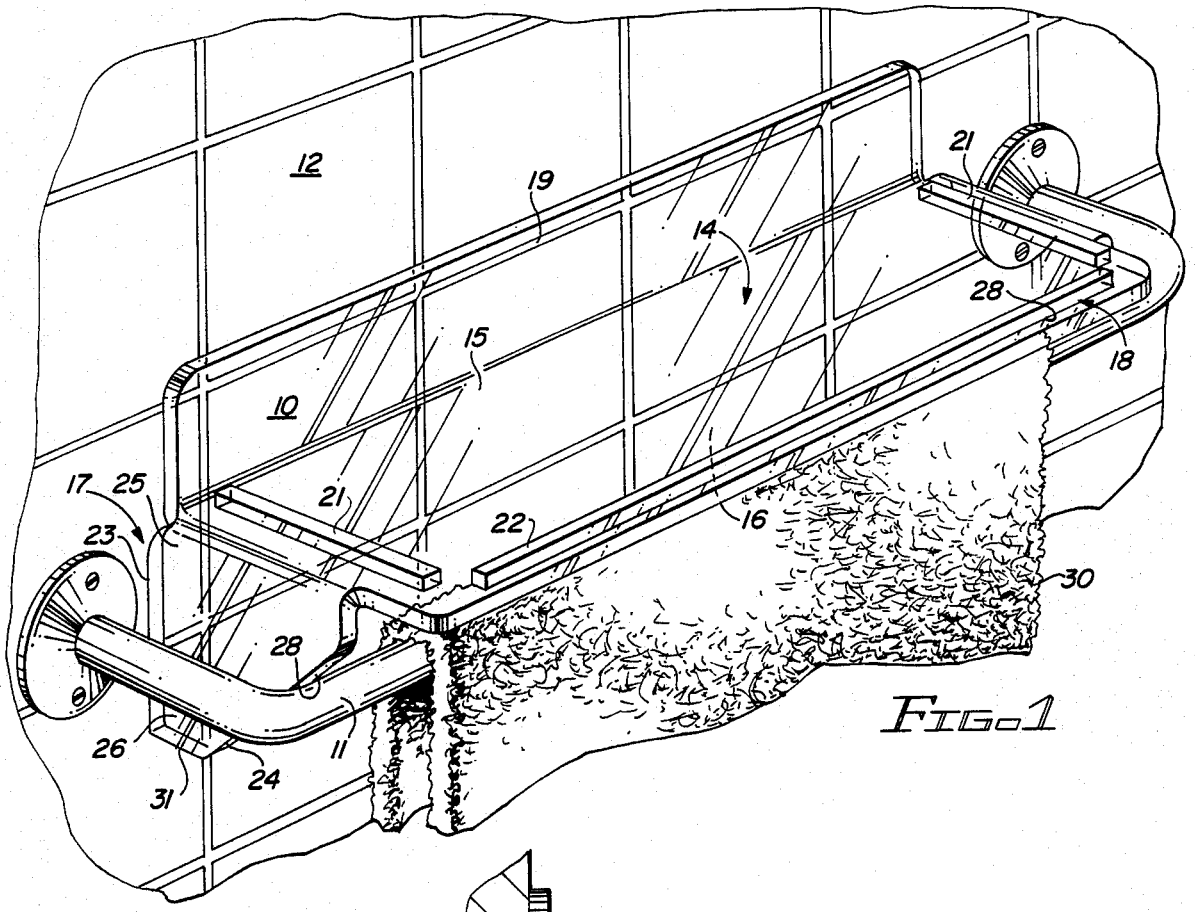
FIG. 1 is a perspective view of the shelf assembly of the invention in combination with a towel bar.

FIG. 1 shows a shelf assembly 10 in accordance with the invention mounted above towel bar 11 which is supported at a fixed distance from a vertical wall, such as a bathroom wall 12. The assembly 10 has a horizontally extending elongated tray 14 having upper and under surfaces 15, 16 and wedge-shaped brackets 17, 18 depending respectively from longitudinally spaced left and right positions along tray 14. The assembly 10 is preferably of unitary construction with the left and right brackets 17, 18 formed integrally as downwardly projecting extensions of the ends of the tray 14.

The rear of tray 14 is advantageously formed with an upwardly extending flange 19 which serves as a shelf back to prevent toiletries or other articles placed on the upper surface 15 of tray 14 from slipping behind the tray 14 and from soiling or scarring the wall 12. The upper surface 15 of the tray 14 is also optionally provided with a peripheral raised rim adjacent the left, front and right edges thereof. Such can conveniently be formed, for example, with rods 21, 22 as shown.

Figure 2:
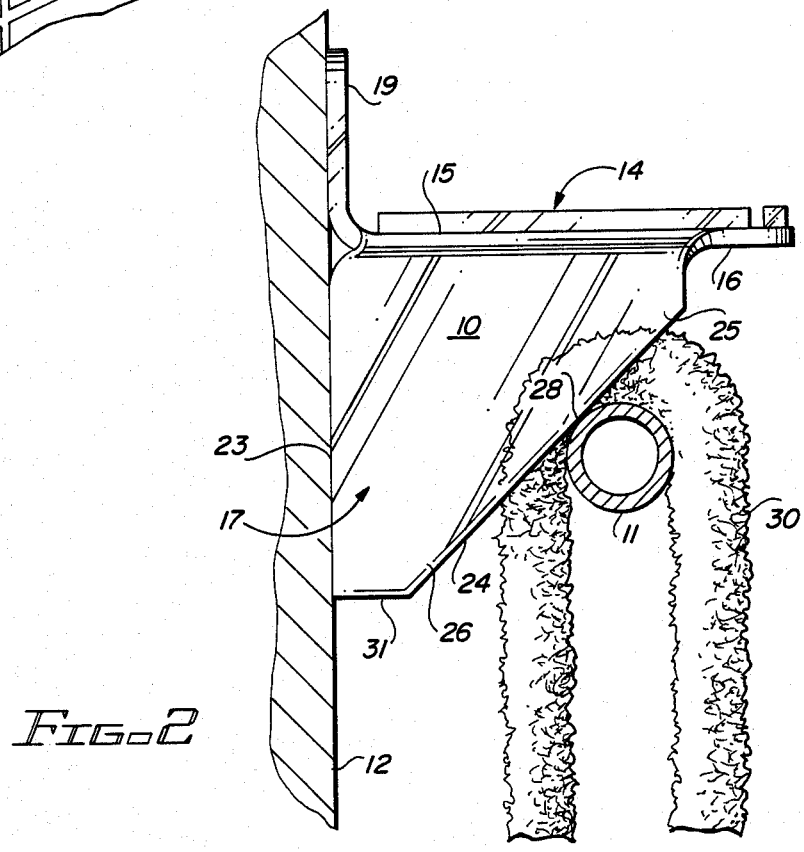
FIG. 2 is a left side elevation view of the same shelf assembly, showing the towel bar in section.

As shown in FIG. 2, each bracket 17, 18 has a vertical rear edge 23 which abuts the wall 12 and an outwardly and upwardly angled front edge 24. Each bracket 17, 18 projects outwardly from the wall 12. An upper section 25 between the edges 23, 24 of the bracket extends outwardly above and beyond the bar 11 for a distance greater than the spacing of the bar 11 from the wall 12. A lower section 26 of the bracket extends outwardly below the bar 11 for a distance less than that spacing. The dimensional differences between the upper and lower sections 25, 26 of the brackets 17, 18 and the angling of the front edges 24 function so that when the brackets 17, 18 are placed from above into the space between the bar 11 and the wall 12 the back of the flange 19 of the tray 14 and the rear edges 23 of the brackets 17, 18 abut the the wall 12, with the brackets 17, 18 depending behind and below the bar 11 until the angled edges 24 come into contact with the bar 11 at points 28 intermediate their upper and lower sections 25, 26, thereby seating the shelf assembly 10.

The dimensioning of the brackets 17, 18 relative to the spacing of the bar 11 from the wall 12 is such that the shelf 10 with brackets 17, 18 wedged behind the bar 11 will be positioned with the underside 16 of the tray 14 sufficiently elevated above the bar 11 so that a towel 30 may be draped over the bar 11 in the customary manner.

Except for ensuring that the functional advantages of securing the tray 14 behind the bar 11 and achieving the self-elevation of the tray 14 sufficiently above the top of bar 11 to permit conventional use of the bar 11, the exact dimensioning of the components of the shelf 10 may be varied to suit individual preferences. As shown in FIGS. 1 and 2, the surfaces 15, 16 of the tray 14 may take the form of rectangular planar surfaces, with brackets 17, 18 of identical construction formed as depending continuations of the left and right ends to abut the wall 12 perpendicularly. Flange 19 may likewise be of rectangular planar configuration forming an upwardly extending continuation of the rear of the horizontal surfaces 15, 16 of the tray 14. The vertical extent of the rear edges 23 of the brackets 17, 18 may be made to be approximately one-quarter as long as, and the vertical extent of flange 19 may be made approximately one-ninth as long as, the length of the long side of surface 15. The front of the tray 14 can, optionally, be made to extend outwardly forward of the outward extensions of the upper sections 25 of the brackets 17, 18.

Suitable dimensions for the assembly 10 are, for example, a length of 14-in. and width of 4¼ in. for the horizontal surfaces 15, 16 of tray 14; a 1½ in. vertical height for the flange 19; and a 3½ in. downward dimension for brackets 17, 18. The lower sections 26 of the brackets 17, 18 may be configured with a lower horizontal edge 31 that projects outwardly from the wall 12 for a distance of ¾ in. before joining the angled edges 24 which may suitably be formed to extend at an angle of 45 degrees relative to the vertical wall 12.

The embodiment of the shelf assembly 10 depicted in FIGS. 1 and 2 shows the angled edge 24 of each bracket 17, 18 to be a straight taper. It will, however, be appreciated that the front edge 24 may take on a different curvature, the overriding consideration being that the brackets 17, 18 fit behind the bar 11 to support the tray 14 in sufficiently elevated position to maintain access to the bar 11, while imparting stability to the shelf 10 to prevent its coming out of its supported position with the lower ends 26 of brackets 17, 18 secured behind the bar 11.

The structure of the shelf 10 may be of a durable transparent or translucent material such as .220 gauge acrylic plastic, flame polished on all edges. Rods 21, 22 may take the form of ¼ in. x ¼ in. acrylic rods appropriately bonded marginally of the upper surface 15 of the tray 14. The acrylic may be clear, or appropriately tinted or smoked to give it an aesthetically pleasing look.

As is evident from the foregoing illustrative example, the invention provides an improved towel bar shelf assembly 10 of simplified construction, usable in a removable fashion in combination with a towel bar 11 spaced a fixed distance from a vertical wall 12 to give a shelf in the form of the upper surface 15 of the tray 14 for supporting cosmetics, other toiletries and the like, at an elevation sufficiently above the bar 11 to leave uninhibited customary access to the underlying bar for towel hanging purposes. It will, of course, be realized that while bar 11 is shown of circular section, that bar 11 may be of other conventional sectional configuration.

Those skilled in the art to which the invention relates will appreciate that various other substitutions and modifications other than those already mentioned may also be made to the embodiment described above, without departing from the spirit and scope of the present invention as defined by the claims appended hereto.

What is claimed is:

1. In combination with a U-shaped towel bar having a middle portion and two end portions; and is adapted to be mounted to a vertical wall, said end portions each having a length defining a spacing distance from said wall so that a towel may be draped over said bar, a removable shelf assembly comprising:

a horizontal elongated tray having an upper surface for supporting articles thereon and an under surface;

a pair of wedge-shaped brackets depending from longitudinally spaced positions along said tray; each bracket having a vertical rear edge, an outwardly and upwardly angled front edge, and upper and lower sections extending outwardly from said rear edge to said front edge; the outward extend of said upper section being greater than said towel bar spacing distance from said wall and the outward extent of said lower section being less than said towel bar spacing distance; with the respective outward extensions of said upper and lower sections and angling of said front edges being such that, when said brackets are placed from above into the space between said towel bar and said wall, said rear edges will abut said wall and said lower sections of said brackets will descend behind and below said bar until said angled edges come into contact with said bar at points intermediate said upper and lower sections, with said brackets being brought to bear against said wall and said bar to seat said shelf assembly on said bar and to cause said rear edges to be retained in abutment with said wall and said under surface of said tray to be sufficiently elevated above said bar to permit normal usage of portions of said bar underlying said tray for draping of a towel thereover.

2. An assembly as in claim 1, wherein said tray further comprises a flange extending upwardly along the rear of said upper surface, said flange being adapted and configured to come into abutment with said wall when said shelf assembly is seated with said rear edges in abutment with said wall.

3. An assembly as in claim 2, wherein said tray, brackets and flange are formed as an integral, unitary structure.

4. An assembly as in claim 3, wherein said shelf assembly is formed of acrylic plastic.

5. An assembly as in claim 2, wherein said tray is further provided with a rim on the periphery of said upper surface away from said flange to confine articles placed thereon.

6. An assembly as in claim 5, wherein said upper surface is a rectangular surface having a rear side adapted and configured to extend longitudinally along said wall when said shelf assembly is seated, and wherein said rim comprises rods running peripherally of left, front and right sides of said upper surface.

7. An assembly as in claim 1, wherein said front edge of each bracket is angled at 45 degrees relative to said rear edge.

8. In combination with a vertical wall and a towel bar supported in laterally spaced position at a distance out from said vertical wall so that a towel may be draped over said bar, a removable shelf assembly of integral, unitary construction comprising:

an elongated tray having horizontal rectangular upper and under planar surfaces and a vertical upwardly extending flange running longitudinally along a rear side of said upper surface; said upper surface serving for supporting articles thereon;

a pair of planar, wedge-shaped brackets depending from the respective ends of said upper and under surfaces of said tray; each bracket having a vertical rear edge, an angled front edge, and vertical upper and lower sections extending outward from said rear edge to said front edge; the outward extent of said upper section being greater than said towel bar spacing distance from said wall, and the outward extent of said lower section being less than said towel bar spacing distance; with the respective outward extensions of said upper and lower sections and angling of said front edges being such that when said brackets are placed from above into the space between said towel bar and said wall, said rear edges and said flange will abut said wall and said lower sections of said brackets will descend behind and below said bar until said angled edges come into contact with said bar at points intermediate said upper and lower sections, with said brackets being brought to bear against said wall and said bar to seat said shelf assembly on said bar and to cause said rear edges and flange to be retained in abutment with said wall and said under surface of said tray to be sufficiently elevated above said bar to permit normal usage of portions of said bar underlying said tray for draping of a towel thereover.

9. An assembly as in claim 8, wherein the front of said tray extends outwardly forward beyond the outward extensions of said upper sections of said brackets.

10. An assembly as in claim 9, further comprising rods running peripherally of left, front and right sides of said upper planar surface to confine articles placed thereon.

11. An assembly as in claim 10, wherein said front edge of each bracket is angled at 45 degrees relative to said read edge.

12. An assembly as in claim 11, wherein said shelf assembly is made of acrylic plastic.

13. An assembly as in claim 9, wherein the vertical extent of the rear edge of each bracket is approximately one-quarter as long as the length of said upper surface of said tray.

14. An assembly as in claim 13, wherein the vertical extent of said flange is approximately one-ninth as long as the length of said upper surface of said tray.

15. An assembly as in claim 14, wherein the length and width of said upper surface are approximately 14 inches and 4½ inches, respectively.

16. In combination with a vertical wall and a towel bar supported in laterally spaced position at a distance out from said vertical wall so that a towel may be draped over said bar, a removable shelf assembly placed from above into the space between said towel bar and said wall, and comprising:

a horizontal elongated tray having an upper surface for supporting articles thereon and an under surface;

a pair of wedge-shaped brackets depending from longitudinally spaced positions along said tray; each bracket having a vertical rear edge abutting said wall, an angled front edge bearing against said bar, and upper and lower sections extending outwardly from said wall between said rear and said front edges; the outward extend of said upper section being greater than said towel bar spacing distance from said wall and the outward extent of said lower section being less than said towel bar spacing distance; with the respective outward extensions of said upper and lower sections and angling of said front edges being such that further descent of said brackets behind and below said bar is prevented by said angled edges coming into contact with said bar at points intermediate said upper and lower sections, said brackets bearing against said wall and said bar to seat said shelf assembly on said bar and to cause said rear edges to be retained in abutment with said wall and said under surface of said tray to be sufficiently elevated above said bar to permit normal usage of portions of said bar underlying said tray for draping of a towel thereover.

* * * * *